US008585876B2

(12) United States Patent
Muramatsu et al.

(10) Patent No.: US 8,585,876 B2
(45) Date of Patent: Nov. 19, 2013

(54) CYLINDER BLOCK PLATE PROCESSING APPARATUS AND SEALING MECHANISM OF THE SAME

(75) Inventors: Hitoshi Muramatsu, Hamamatsu (JP); Seiya Kunioka, Hamamatsu (JP); Naoyuki Suda, Hamamatsu (JP); Akira Ishibashi, Hamamatsu (JP); Tomohiro Asou, Hamamatsu (JP); Manabu Suzuki, Hamamatsu (JP); Masahiro Ogawa, Hamamatsu (JP); Minoru Imai, Hamamatsu (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 196 days.

(21) Appl. No.: 13/061,654

(22) PCT Filed: Sep. 1, 2009

(86) PCT No.: PCT/JP2009/065248

§ 371 (c)(1),
(2), (4) Date: Mar. 1, 2011

(87) PCT Pub. No.: WO2010/026958

PCT Pub. Date: Mar. 11, 2010

(65) Prior Publication Data

US 2011/0162961 A1 Jul. 7, 2011

(30) Foreign Application Priority Data

Sep. 2, 2008 (JP) ..... 2008-225262

(51) Int. Cl.
*C25F 7/00* (2006.01)
*C25F 3/00* (2006.01)
*C25F 3/02* (2006.01)

(52) U.S. Cl.
USPC ..... 204/272; 205/640; 205/672

(58) Field of Classification Search
USPC ..... 204/224 R, 272, 260; 205/98, 131, 660
See application file for complete search history.

(56) References Cited

U.S. PATENT DOCUMENTS 5,620,575 A * 4/1997 Karasawa et al. ..... 204/272
5,682,676 A * 11/1997 Ikegaya ..... 29/888.06
5,909,721 A * 6/1999 Ikegaya ..... 123/193.2

FOREIGN PATENT DOCUMENTS

JP 7-118891 5/1995
JP 2000-192287 7/2000

OTHER PUBLICATIONS www.thefreedictionary.com, Crankpin definition.*
www.ustudy.in, Crankpin Journals definition.*
English Translation of the International Preliminary Report on Patentability for International Application No. No. PCT/JP2009/065248 and Written Opinion.

* cited by examiner

*Primary Examiner* — Luan Van
*Assistant Examiner* — Ho-Sung Chung
(74) *Attorney, Agent, or Firm* — Barnes & Thornburg LLP

(57) ABSTRACT

A cylinder block plate processing apparatus in which one end side of an inner peripheral surface of a cylinder of a cylinder block is sealed to circulate a process liquid to perform pre-plating or plating processing of the cylinder inner peripheral surface. The apparatus includes: an apparatus body having a workpiece mount table on which the cylinder block is placed; a workpiece holding tool that is provided on the workpiece mount table so as to be vertically movable; an electrode support member including an electrode cylinder mounted to the apparatus body; a processing solution supply member that supplies a processing solution to the electrode support member; an electrode operated by the electrode cylinder; a sealing jig provided to one end of the electrode; a driving mechanism that drives the sealing jig; and a control circuit that controls operations of the processing solution supply member and the driving mechanism.

4 Claims, 6 Drawing Sheets

CYLINDER BLOCK PLATE PROCESSING APPARATUS AND SEALING MECHANISM OF THE SAME

TECHNICAL FIELD

The present invention relates to a cylinder block plate processing apparatus (or merely plating apparatus), and more particularly, to a cylinder block plate processing apparatus that seals one end side of an inner peripheral surface of a cylinder of a cylinder block to circulate a process (treatment) liquid and performs pre-plate processing or treatment or plate processing of the cylinder inner peripheral surface, and also relates to a sealing mechanism thereof.

BACKGROUND ART

Conventionally, there is disclosed a cylinder block plate processing apparatus for sealing one end side (crankcase surface side) of an inner peripheral surface of a cylinder of a cylinder block to circulate a process liquid, and performs pre-plate processing or plate processing of the cylinder inner peripheral surface (for example, Japanese Patent Laid-Open Publication No. 8-74095: Patent Document 1). This conventional example describes an apparatus in which a balloon-shaped sealing member is inserted from a crankcase surface side into a cylinder, and the sealing member seals the crankcase surface side of a cylinder inner peripheral surface.

However, in recent engines, pitches of a plurality of cylinders tend to be reduced in term of a demand for a size reduction. In a cylinder block of such an engine, a crank journal that journals a crankshaft with a crankcase is formed to overhang inward of the cylinder on a crankcase surface side.

When plate processing to such a cylinder block is performed, if a sealing member is to be inserted from the crankcase surface side, the sealing member interferes with the crank journal, and thus, a shape thereof is significantly limited and becomes complex.

When the sealing member is inserted from the crankcase surface side into the cylinder so as to avoid the crank journal so as to seal thereafter the entire cylinder inner peripheral surface, an amount or rate of size change in expansion/contraction of the sealing member becomes excessive, and then, the sealing accuracy of the sealing member is reduced, and the cylinder inner peripheral surface cannot be reliably sealed.

DISCLOSURE OF THE INVENTION

In view of the circumstances described above, an object of the present invention is to provide a cylinder block plate processing apparatus including a sealing mechanism that ensures sealing accuracy of a sealing jig and reliably seals a cylinder inner peripheral surface even in a case of a cylinder block having a complex shape with an obstacle around one end side of the cylinder inner peripheral surface.

In order to achieve the above-described object, the present invention provides a cylinder block plate processing apparatus in which a sealing jig seals one end side of a cylinder inner peripheral surface of a cylinder of a cylinder block, and a process liquid is guided to the cylinder inner peripheral surface to perform pre-plating processing or plating processing of the cylinder inner peripheral surface, wherein the sealing jig is provided at a front end portion of an electrode, a driving mechanism that operates a sealing member of the sealing jig is placed separately from the sealing jig, the electrode and the sealing jig are inserted from the other end side of the cylinder inner peripheral surface into the cylinder, and the driving mechanism is inserted from the one end side so as to be connectable to the sealing jig.

The object of the present invention is also achieved by providing a cylinder block plate processing apparatus in which one end side of a cylinder inner peripheral surface of a cylinder of a cylinder block is sealed to circulate a process liquid to perform pre-plating processing or plate processing of the cylinder inner peripheral surface, the apparatus including: an apparatus body having a workpiece mount table on which the cylinder block is placed; a workpiece holding tool that is provided on the workpiece mount table so as to be vertically movable; an electrode support member including an electrode cylinder mounted to the apparatus body; a processing solution supply member that supplies a processing solution to the electrode support member; an electrode operated by the electrode cylinder; a sealing jig provided at one end of the electrode; a driving mechanism that drives the sealing jig; and a control circuit that controls operations of the processing solution supply member and the driving mechanism, wherein the sealing jig includes a sealing member, the driving mechanism that drives the sealing member includes an air cylinder placed separately from the sealing jig, the electrode and the sealing jig are inserted from the other end side of the cylinder inner peripheral surface into the cylinder, and the driving mechanism is inserted from an end side of the inner peripheral surface so as to be connectable to the sealing jig.

The embodiment of the present invention also provides a sealing mechanism of a cylinder block plate processing apparatus that includes the sealing mechanism which seals one end side of a cylinder inner peripheral surface of a cylinder of a cylinder block, and in which a process liquid is guided to the cylinder inner peripheral surface to perform pre-plating processing or plating processing of the cylinder inner peripheral surface, wherein the sealing mechanism includes a sealing jig including a sealing member and a driving mechanism that drives the sealing member, in which the sealing jig is placed separately from the driving mechanism to a front end portion of an electrode provided for the plate processing apparatus, the electrode and the sealing jig are inserted from the other end side of the cylinder inner peripheral surface into the cylinder, and the driving mechanism is inserted from the one end side so as to be connectable to the sealing jig.

The sealing jig in the embodiment of the present invention includes the sealing member, a sealing plate that engages the sealing member, and a sealing base that engages the sealing member and the sealing plate, and the sealing member, the sealing plate, and the sealing base are integrally engaged to form an air channel inside.

The sealing member of the sealing jig may have an outer diameter close to an inner diameter of the cylinder inner peripheral surface.

It may be desired that an elastic member for absorbing shock and ensuring air-tightness is provided in at least one of connecting portions of the sealing jig and the driving mechanism.

According to the present invention having the above-described structures and features, even in a case of being provided with a cylinder block having a complex shape with an obstacle around one end side of the cylinder inner peripheral surface, the sealing jig can be inserted from the other end side of the cylinder inner peripheral surface into the cylinder, and the sealing member of the sealing jig does not need to avoid the obstacle. Thus, an outer diameter of the sealing member can be set close to an inner diameter of the cylinder inner peripheral surface, which can reduce an amount of expansion and contraction of the sealing member of the sealing jig, thereby ensuring sealing accuracy by the sealing jig, and reliably sealing the cylinder inner peripheral surface using the sealing jig. According to the plate processing apparatus including the sealing mechanism of the present invention, satisfactory plate processing of the cylinder block can be performed.

BRIEF DESCRIPTION OF THE DRAWINGS

[FIG. 5] shows the sealing jig in FIG. 2, in which

BEST MODE FOR CARRYING OUT THE INVENTION

Hereunder, the best mode for embodying the present invention will be described with reference to the accompanying drawings.

It is to be noted that the present invention is not limited to the embodiment, and in the following descriptions, terms representing positions such as upper, lower, left and right are used based on illustrated states or actual installation states.

Figure 1:
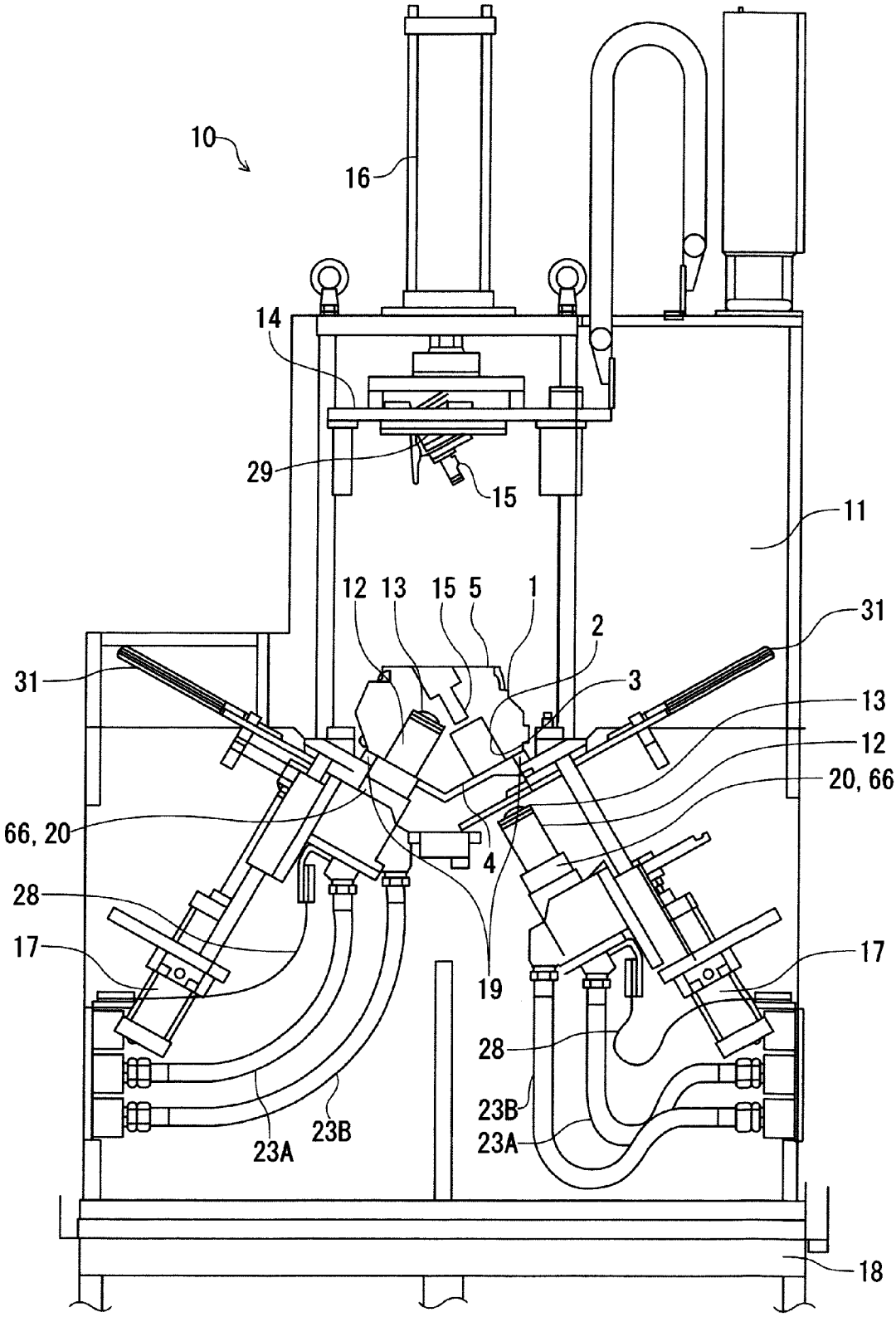
[FIG. 1] is a front view of a general schematic structure of a cylinder block plate processing apparatus including a sealing mechanism according to the present invention.

In a processing (treatment) apparatus 10 according to an embodiment of the present invention in FIG. 1, a sealing jig 13 (FIG. 2) seals an end on a side of a crankcase surface 5 that is one end side of a cylinder inner peripheral surface 3 of a cylinder block 1 of an engine, and a process liquid (pre-plating liquid or plating liquid) is guided to the cylinder inner peripheral surface 3 to treat the cylinder inner peripheral surface 3 at high speed (pre-plating or plating processing). The processing apparatus 10 includes an apparatus body 11, an electrode 12, a sealing jig 13, a workpiece holding jig 14, an air joint 15, a clamp cylinder 16, and an electrode cylinder 17.

In this embodiment, the cylinder block 1 is a V-type cylinder block of a V-type multi-cylinder engine. Inner peripheral surfaces 3 of a plurality of cylinders 2 formed with predetermined angular differences in the cylinder block 1 are simultaneously subjected to pre-plating or plating processing by the processing apparatus 10. Thus, the processing apparatus 10 functions as a cylinder block pre-plating apparatus such as an electrolytic etching processing apparatus or an anode oxidation processing apparatus for the cylinder block 1, and/or a cylinder block plating processing apparatus.

Figure 6:
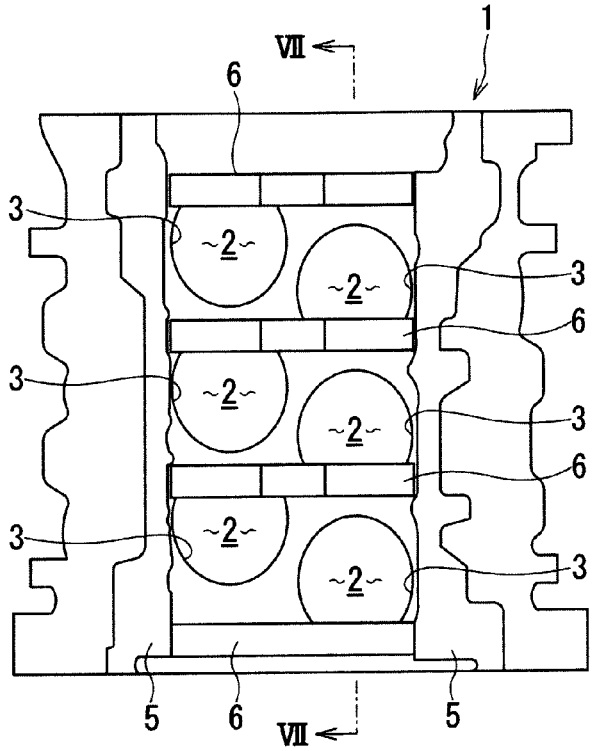
[FIG. 6] is a schematic plan view of the cylinder block in FIG. 1 seen from a crankcase surface side.
Figure 7:
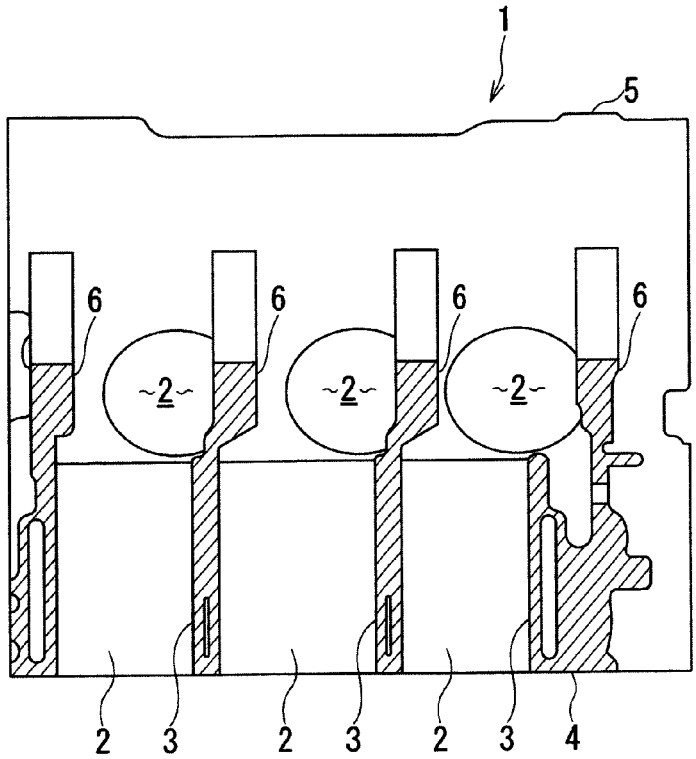
[FIG. 7] is a sectional view taken along the line VII-VII in FIG. 6.

In the cylinder block 1, as shown in FIGS. 6 and 7, a crank journal 6 for journaling a crankshaft with a crankcase (both not shown) is formed around the end of the cylinder inner peripheral surface 3 on the side of the crankcase surface of each of the plurality of cylinders 2. In the cylinder block 1 with a short arrangement pitch of the plurality of cylinders 2, the crank journal 6 is formed to overhang inward of the cylinder 2 around the end of the cylinder inner peripheral surface 3 on the side of the crankcase surface 5, and thus, constitutes an obstacle around the end of the cylinder inner peripheral surface 3 on the side of the crankcase surface 5.

As shown in FIG. 1, the apparatus body 11 of the processing apparatus 10 includes a workpiece mount table 19 provided and secured on a frame 18 and on which the cylinder block 1 is placed. The cylinder block 1 is placed on the workpiece, mount table 19 with a head surface 4 downward. In the apparatus body 11, a workpiece holding jig 14 is provided above the workpiece mount table 19 so as to be vertically movable by the clamp cylinder 16. A clamp, not shown, is provided in the workpiece holding jig 14. The workpiece holding jig 14 abuts against the crankcase surface 5 of the cylinder block 1 placed on the workpiece mount table 19 in a vertically lowered position. At this time, the clamp of the workpiece holding jig 14 grips the side of the crankcase surface 5 of the cylinder block 1, and the cylinder block 1 is held between the workpiece mount table 19 and the workpiece holding jig 14.

Figure 3:
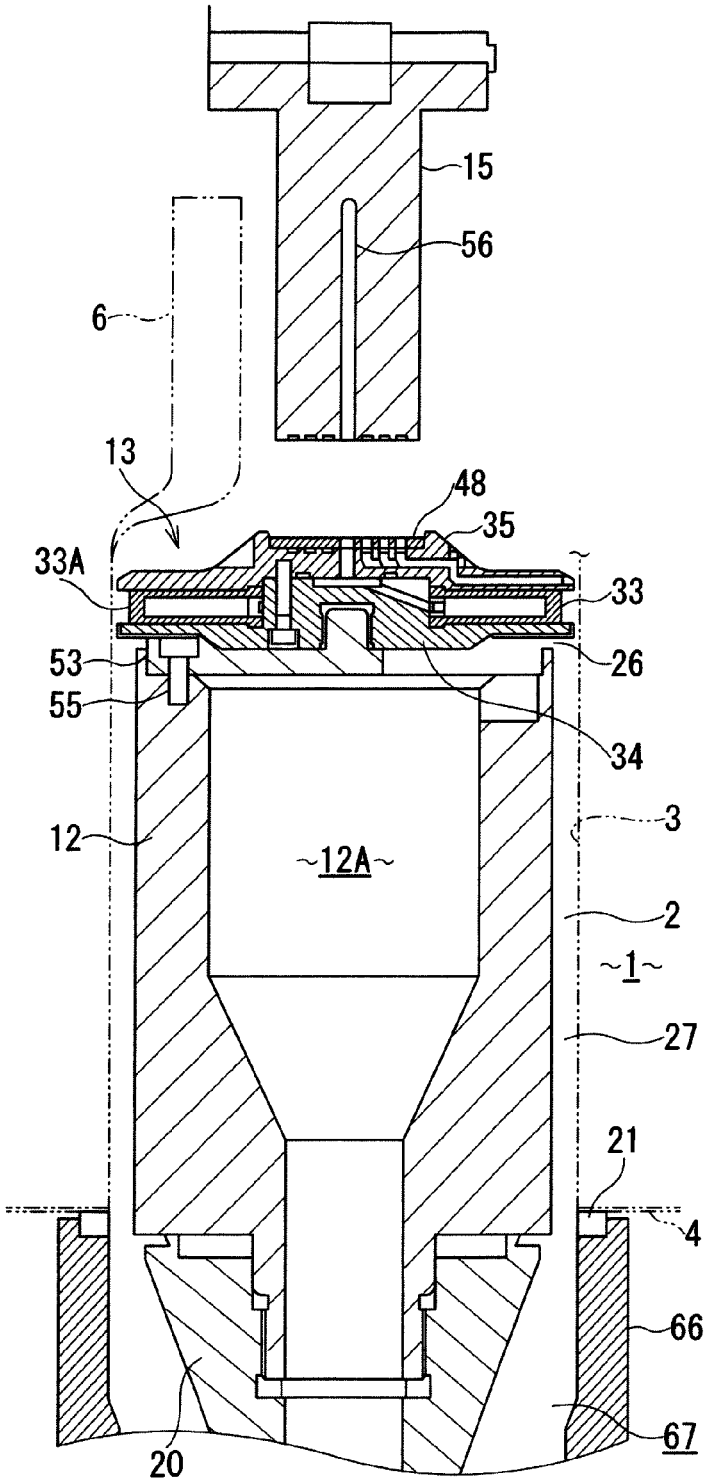
[FIG. 3] is a sectional view showing an unconnected state (standby state) of an air cylinder and a sealing jig in FIG. 2.

At this time, as shown by a dash-single-dot line in FIG. 1 and in FIG. 3, the air joint 15 is inserted from the side of the crankcase surface 5 of the cylinder block 1 into the cylinder block 1 so as to face the sealing jig 13 (the electrode 12 and the jig 13 on a right side in FIG. 1) provided at an upper end of the electrode 12, and the air joint 15 then waits in a standby position apart from the sealing jig 13.

The electrode 12 is supported by an electrode support portion 20, and the electrode support portion 20 is mounted to an electrode cylinder 17 provided in the apparatus body 11. The electrode cylinder 17 is advanced and retracted, and thus the electrode 12 is inserted into the cylinder 2 of the cylinder block 1 from an end of the cylinder inner peripheral surface 3 on a side of the head surface 4, or retracted from the cylinder 2 of the cylinder block 1.

The electrode 12 on the left side in FIG. 1 shows an inserted state into the cylinder 2, and the electrode 12 on the right side in FIG. 1 shows a retracted state from the cylinder 2. When the electrode 12 is inserted into the cylinder 2 of the cylinder block 1, a sealing ring 21 (FIG. 2) such as a silicone rubber sheet provided on a channel constituting block 66 is brought into contact with the head surface 4 of the cylinder block 1 to seal the end (the other end side) of the cylinder inner peripheral surface 3 on the side of the head surface 4.

The channel constituting block 66 is integrated into the electrode support portion 20 and operated together with the electrode support portion 20 and the electrode 12 by the operation of the electrode cylinder 17 Further, a process liquid channel 67 is formed between the channel constituting block 66 and an outer peripheral surface of the electrode support portion 20. A process liquid channel (inter-electrode channel 12A) is also formed in the electrode 12.

Figure 2:
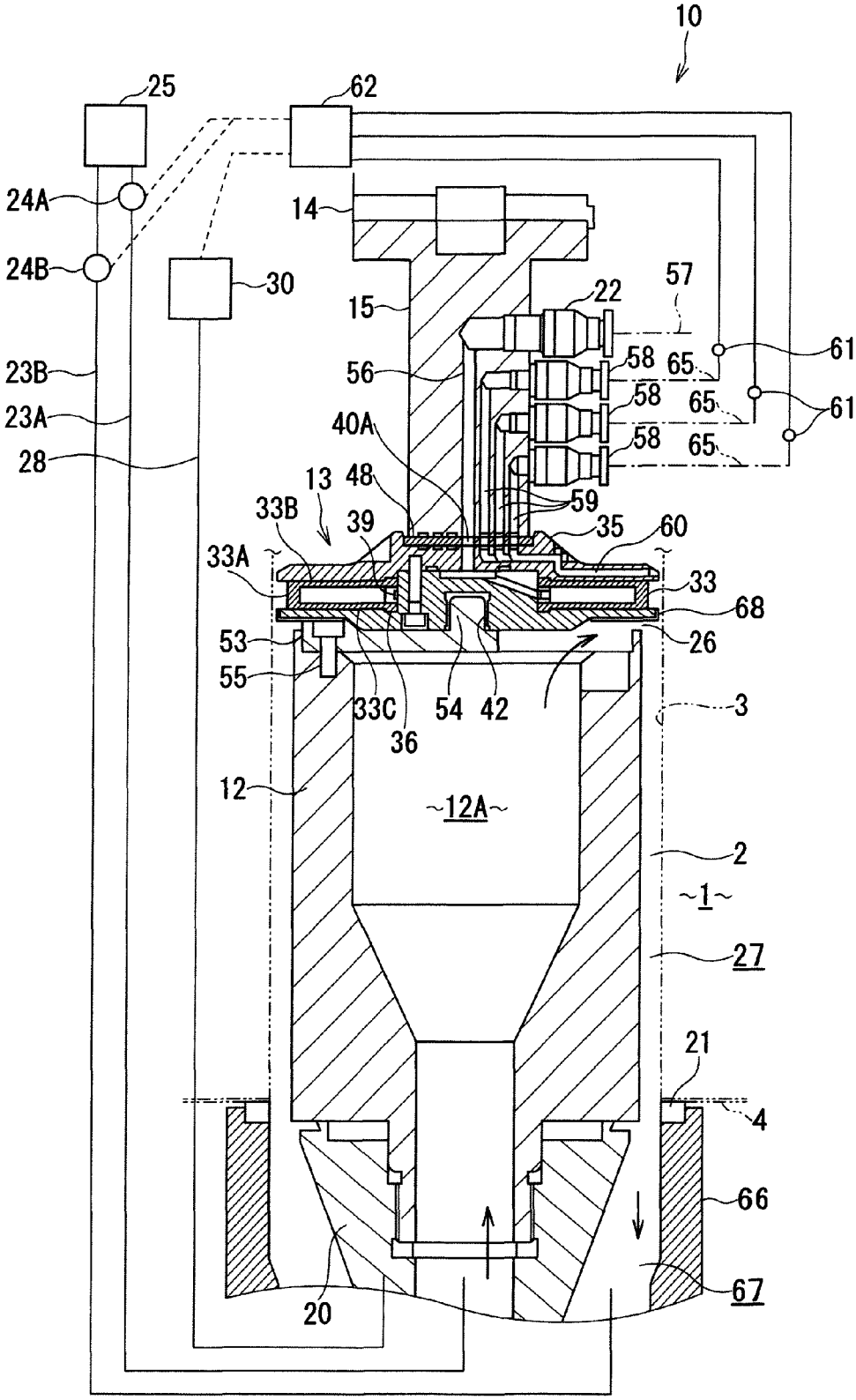
[FIG. 2] is a sectional view showing an electrode and a portion around an air joint in the plate processing apparatus in FIG. 1.

As shown in FIGS. 1 to 3 and as described above, the sealing jig 13 is provided at the upper end of the electrode 12, and on the workpiece holding jig 14, the air joint 15 as a driving mechanism for operating a sealing member 33 of the sealing jig 13 is placed separately from the sealing jig 13 in an upper position of the sealing jig 13 and the electrode 12.

The sealing jig 13 is inserted together with the electrode 12 from the end of the cylinder inner peripheral surface 3 on the side of the head surface 4 into the cylinder by an advancing operation of the electrode cylinder 17. Thus, there is no need to insert the sealing jig 13 so as to avoid the crank journal 6 shown in FIGS. 3, 6 and 7 from interfering. Thus, the sealing jig 13 includes the sealing member 33, and the sealing member 33 has an outer diameter close to an inner diameter of the cylinder inner peripheral, surface 3, that is, an outer diameter slightly smaller than the inner diameter the cylinder inner peripheral surface 3 to reduce an amount of expansion and contraction described later.

Figure 4:
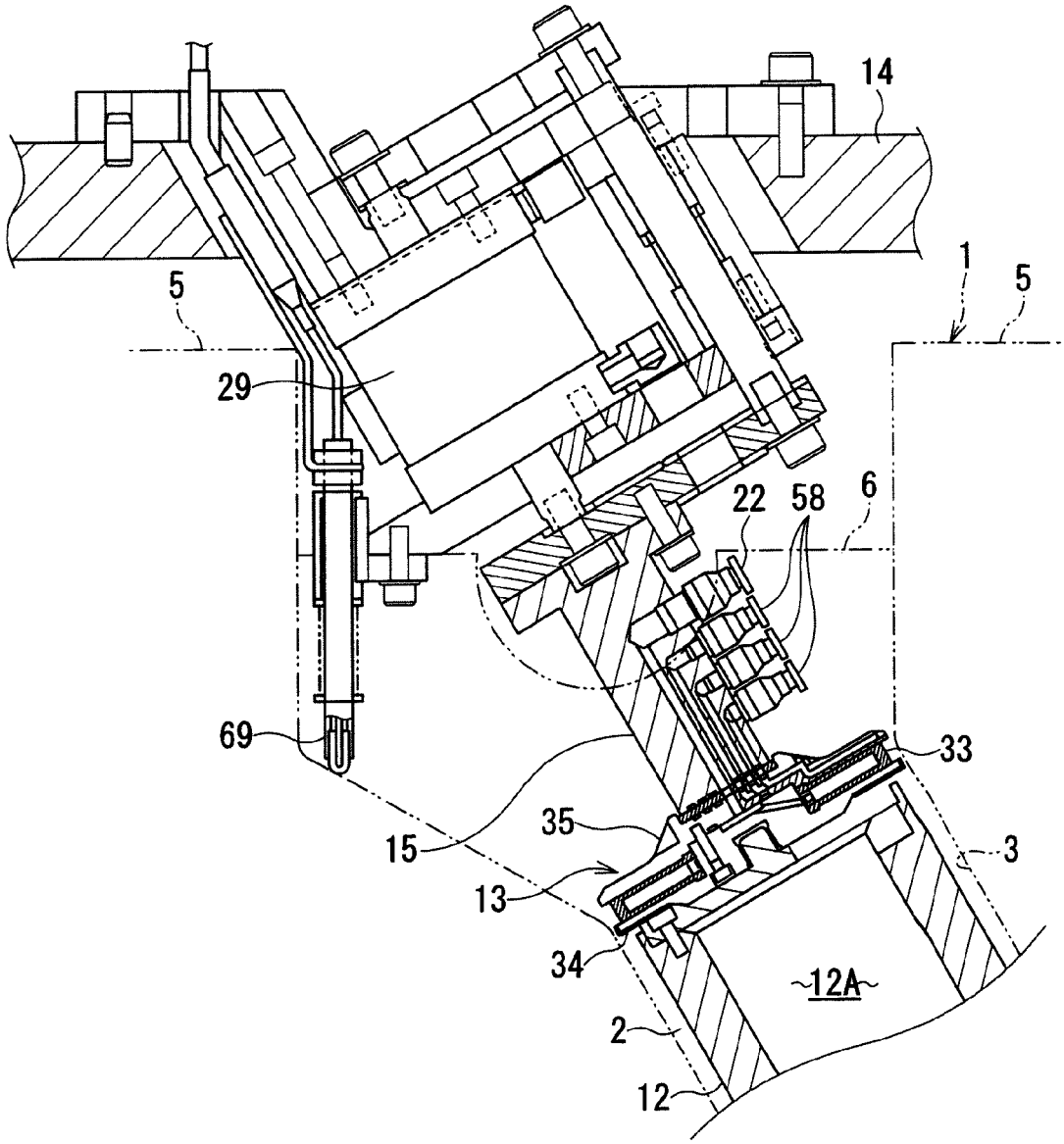
[FIG. 4] is a sectional view showing a connected state of the air joint and the sealing jig in FIG. 2 together with an air joint cylinder.

The air joint 15 supplies air as a working fluid for operating the sealing member 33 of the sealing jig 13 to the sealing member 33. As shown in FIG. 4, the air joint 15 is provided in an air joint cylinder 29 secured to the workpiece holding jig 14, and located movably between an advanced position shown in FIGS. 2 and 4 and a standby position shown by a dash-double-dot line in FIG. 1 and in FIG. 3 by advancing and retracting operations of the air joint cylinder 29. Thus, the air joint 15 is moved from the standby position shown in FIG. 3 toward the cylinder 2 by the advancing operation of the air joint cylinder 29, and provided so as to be connectable to the sealing jig 13 inserted into the cylinder 2 as shown in FIGS. 2 and 4.

Specifically, for the sealing jig 13 and the air joint 15, the air joint 15 abuts against and is connected to the sealing jig 13 by the advancing operation of the air joint cylinder 29 after the electrode 12 has been inserted into the cylinder 2 of the cylinder block 1, and as described later in detail, air as a fluid is supplied from a main air joint member 22 of the air joint 15 to the sealing member 33 of the sealing jig 13. Thus, the sealing member 33 is expanded only in a radial direction and brought into contact with the cylinder inner peripheral surface 3 of the cylinder block 1 to seal the end (one end side) of the cylinder inner peripheral surface 3 on the side of the crankcase surface 5. After the supply of air to the sealing member 33 is stopped and the sealing member 33 is contracted, the air joint 15 is returned to the standby position by the retracting operation of the air joint cylinder 29.

The main air joint member 22 and a sub air joint member 58, described later, provided in the air joint 15 are provided so as to avoid the crank journal 6 of the cylinder block 1 as shown in FIGS. 3 and 4, and prevented from interfering with the crank journal 6. Reference numeral 69 in FIG. 4 denotes a temperature sensor for measuring a temperature of the cylinder block 1 under treatment, which is placed adjacent to the air joint cylinder 29 in the workpiece holding jig 14.

To the electrode support portion 20 shown in FIG. 1, a process liquid pipe 23A is connected, and a liquid feed pump 24A (FIG. 2) is provided in the process liquid pipe 23A. The liquid feed pump 24A guides a process liquid (plating liquid) stored in a drug solution storage tank 25 through the process liquid pipe 23A and the electrode support portion 20 to the inter-electrode channel 12A in the electrode 12 in a state where the end of the cylinder inner peripheral surface 3 on the side of the crankcase surface 5 of the cylinder block 1 is sealed by the sealing member 33.

The process liquid guided to the inter-electrode channel 12A flows upward through the inter-electrode channel 12A as shown by the arrow in FIG. 2, flows through a slit 26 formed between a sealing lower plate 34, described later, of the sealing jig 13 and the electrode 12, flows downward in a space 27 defined by an outer peripheral surface of the electrode 12 and the cylinder inner peripheral surface 3 of the cylinder block 1, flows through the channel 67 configured by the electrode support portion 20 and the channel constituting block 66, and returns to the drug solution storage tank 25 and circulates.

A process liquid pipe 23B is connected to the channel constituting block 66, and a liquid feed pump 24B is provided in the process liquid pipe 23B. The liquid feed pump 24B guides a process liquid (plating preprocess liquid) stored in the drug solution tank 25 through the process liquid pipe 23B and the channel 67 configured by the electrode support portion 20 and the channel constituting block 66 sequentially into the space 27 between the electrode 12 and the cylinder inner peripheral surface 3, and upward in the space 27 in a state where the end of the cylinder inner peripheral surface 3 on the side of the crankcase surface 5 of the cylinder block 1 is sealed by the sealing member 33. The process liquid having flown in the space 27 flows through the slit 26 between the sealing jig 13 and the electrode 12 to the inter-electrode channel 12A in the electrode 12, flows downward in the inter-electrode channel 12A, returns to the drug solution tank 25 and thus circulates in this root. The process liquid pipes 23A and 23B are formed of flexible hoses.

As shown in FIGS. 1 and 2, a bendable lead wire 28 is connected to the electrode support portion 20, and the lead wire 28 is connected to a power supply device 30. The power supply device 30 supplies power through the lead wire 28 and the electrode support portion 20 to the electrode 12 in a state where the space 27 is filled with the process liquid and the process liquid flows. In ore-plating processing, the power is supplied so that the electrode 12 is a negative pole and the cylinder block 1 is a positive pole, and thus, the cylinder inner peripheral surface 3 of the cylinder block 1 is subjected to the pre-plating processing or treatment. In the plating (plate) processing, the power is supplied so that the electrode 12 is a positive pole and the cylinder block 1 is a negative pole, and the cylinder inner peripheral surface 3 is subjected to the plate processing, and a plating film is formed on the cylinder inner peripheral surface 3. The pre-plating processing and the plate processing are performed by the same processing apparatus 10 by changing process liquids, energizing (current conducting) conditions, or the like.

Further, although FIG. 1 shows only one air joint 15, a plurality of air joints 15 of the number corresponding to the number of the electrodes 12 (that is, the number of cylinders 2 of the cylinder block 1) are mounted to the workpiece holding jig 14. Reference numeral 31 in FIG. 1 denotes a washing shutter, which advances after the cylinder inner peripheral surface 3 of the cylinder block 1 is subjected to the pre-plating processing or treatment or plating processing and the electrode 12 is retracted from the cylinder block 1. The washing shutter 31 is used to spray a washing fluid to the head surface 4 of the cylinder block 1 for washing.

Hereunder, the sealing jig 13 and the air joint 15 or the like will be described in detail in their structures with reference to FIGS. 2 and 5.

The sealing jig 13 is brought into contact with the end of the cylinder inner peripheral surface 3 on the side of the crankcase to seal the cylinder inner peripheral surface 3 when a process liquid is guided into the space 27 including the cylinder inner peripheral surface 3 of the cylinder block 1.

The sealing jig 13 includes the sealing member 33, the sealing lower plate 34 and a sealing base 35.

As shown in FIG. 5, the sealing member 33 is made of a stretch material (for example, an elastic member such as rubber) and formed into a swim ring shape. An inner peripheral portion of the sealing member 33 is opened to provide an opening portion 49, and engagement protrusions 36 are formed on both sides near the opening portion 49. An outer peripheral portion 33A of the sealing member 33 can be brought into contact with the cylinder inner peripheral surface 3 of the cylinder block 1. An outer diameter of the outer peripheral portion 33A of the sealing member 33 is set to be slightly smaller than an inner diameter of the cylinder inner peripheral surface 3 in a state that any air is not supplied in the sealing member 33.

As shown in FIG. 5, the sealing lower plate 34 has a disk portion 32 having a central portion on which an expanded portion 37 is integrally formed. A ring member 39 having a circumferential groove 38 is formed in an outer periphery of the expanded portion 37. Main air channels 40C and 40D are formed so as to communicate with each other in the expanded portion 37. A plurality of, for example, three main air channels 40D, are formed at an equal interval with each other in a circumferential direction of the sealing lower plate 34. The main air channels 40D communicate with the circumferential groove 38 in the ring member 39, and communicate with a plurality of (for example, three) main air channels 40E formed in a circumferential direction of the ring member 39 so as to communicate with the circumferential groove 38.

In the disk portion 32 of the sealing lower plate 34, an engagement groove 41 is formed into a ring shape at an interface with the expanded portion 37. The engagement protrusion 36 of the sealing member 33 engages the engagement groove 41. In the disk portion 32 and the expanded portion 37, a fastening female thread portion 42 and a bolt through hole 44 through which a bolt 43 is inserted are provided. In the sealing lower plate 34 thus configured, the disk portion 32 supports one side surface (lower side surface 33C in FIG. 5) of the sealing member 33 in a state where the opening portion 49 of the sealing member 33 is fitted to the ring member 39, and the engagement protrusion 36 of the sealing member 33 is engaged with the engagement groove 41.

As shown in FIG. 5, the sealing base 35 has a disk portion 45 having a central portion which is integrally formed with an expanded portion 46, and a sheet seat 47 and a main air channel 40B are formed in the expanded portion 46. A sealing sheet 48 is mounted to the sheet seat 47, and a main air channel 40A communicating with the main air channel 40B is formed in the sealing sheet 48. The main air channel 40B is provided so as to communicate with the main air channel 40C of the sealing lower plate 34.

In the disk portion 45, a recess 50 in which the expanded portion 37 of the sealing lower plate 34 can be fitted is formed in a position opposite to the sheet seat 47, and an engagement groove 51 is formed into a ring shape outside the recess 50. The engagement protrusion 36 of the sealing member 33 engages the engagement groove 51. A bolt screw hole 52 into which the bolt 43 is screwed is formed in the disk portion 45 and the expanded portion 46.

In a state where the expanded portion 37 of the sealing lower plate 34 fits in the recess 50 in the sealing base 35, the opening portion 49 of the sealing member 33 fits in the ring member 39 of the sealing lower plate 34, the engagement protrusion 36 of the sealing member 33 engages the engagement groove 41 in the sealing lower plate 34 and the engagement groove 51 in the sealing base 35, the bolt 43 is screwed into the bolt screw hole 44 in the sealing lower plate 34 and the bolt screw hole 52 in the sealing base 35, and the sealing member 33, the sealing lower plate 34, and the sealing base 35 are integrated so as to constitute the sealing jig 13.

In this state, the sealing lower plate 34 and the sealing base 35 are placed to face each other, the disk portion 32 of the sealing lower plate 34 supports one side surface (lower side surface 33C in FIG. 5) of the sealing member 33, and the disk portion 45 of the sealing base 35 supports the other end surface (upper side surface 33B in FIG. 5) of the sealing member 33. Further, in a state where the sealing member 33, the sealing lower plate 34, and the sealing base 35 are integrated, the main air channels 40A, 40B, 40C, 40D and 40E communicating with each other communicate with an inside of the sealing member 33

As shown in FIG. 2, the sealing jig 13 is mounted to the upper end of the electrode 12 via a sealing jig mounting plate 53 as an insulating member. The sealing jig mounting plate 53 is formed into a substantially cross shape with cuts in four directions, and a fastening male thread portion 54 is formed at a center. A tip of the substantially cross-shaped sealing jig mounting plate 53 is secured to the electrode 12 by the bolt 55. The male thread portion 54 on the sealing jig mounting plate 53 is threaded on the female thread portion 42 on the sealing lower plate 34 of the sealing jig 13, and the sealing jig 13, in which the sealing member 33, the sealing lower plate 34, and the sealing base 35 are integrated, is mounted to the sealing jig mounting plate 53.

The sealing jig mounting plate 53 is made of non-conductive resin or the like, and is insulated from the sealing lower plate 34 and the sealing base 35 made of conductive metal from the electrode 12. A process liquid flows through the cut portions in the substantially cross-shaped sealing jig mounting plate 53 toward the slit 26, for example, as shown by the arrow in FIG. 2. In order to further increase an insulating property, an insulation collar 68 is mounted to a lower surface on an outer peripheral side of the sealing jig mounting plate 53.

The air joint 15 shown in FIGS. 1 and 2 includes the main air joint member 22 as described above and is formed with a main air supply channel 56. The main air joint member 22 is connected via a main air supply pipe 57 to an air supply valve, not shown, and a compressor. The air joint 15 is inserted from the standby position shown in FIG. 3 toward the cylinder 2 by the advancing operation of the air joint cylinder 29 after the electrode 12 has been inserted into the cylinder 2 of the cylinder block 1, and abuts against the sealing sheet 48 of the sealing jig 13 mounted to the electrode 12 and is connected to the sealing jig 13. In the connected state, the main air supply channel 56 of the air joint 15 communicates with the main air channel 40A in the sealing sheet 48 of the sealing jig 13.

The air is supplied from the main air supply channel 56 to the main air channel 40A, and the sealing sheet 48 prevents leakage of air at this time.

The sealing sheet 48 attains a function of ensuring airtightness for preventing leakage of air and also a function of absorbing shock in abutment of the air joint 15. Thus, the sealing sheet 48 is preferably made of an elastic member such as silicone rubber or Teflon (registered trademark of DuPont) rubber. The sealing sheet 48 may be provided on a tip of the air joint 15 instead of being mounted to the sealing base 35 of the sealing jig 13, or provided on both the sealing base 35 of the sealing jig 13 and the tip of the air joint 15.

Figure 5A:
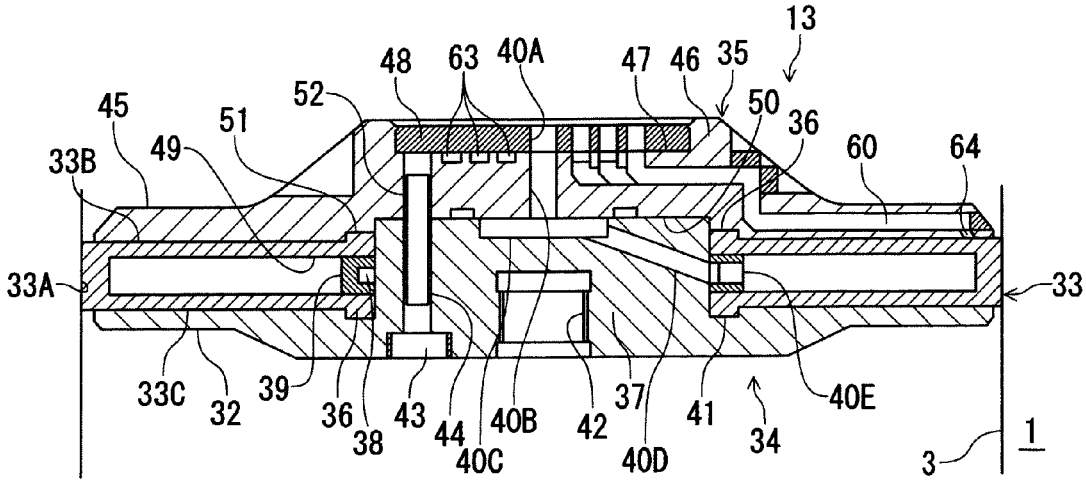
FIG. 5A is a sectional view showing an expanded state of the sealing member and FIG. 5B is a sectional view showing a contracted state of the sealing member.

As shown in FIG. 5, the air supplied from the main air supply channel 56 to the main air channel 40A is introduced through the main air channels 40B, 40C, 40D and 40E into the sealing member 33. The upper side surface 33B of the sealing member 33 is supported by the sealing base 35 and the lower side surface 33C is supported by the sealing lower plate 34, and expansion of the sealing member 33 is restricted. Thus, as shown in FIG. 5A, the sealing member 33 is expanded only in the radius direction, the outer peripheral portion 33A of the sealing member 33 is brought into contact with the cylinder inner peripheral surface 3 of the cylinder block 1 to thereby seal the end of the cylinder inner peripheral surface 3 on the side of the crankcase surface 5. Thus, the pre-plating process liquid or a plating liquid can be prevented from leaking from the space 27 (FIG. 2) defined by the cylinder inner peripheral surface 3 and the outer peripheral surface of the electrode 12 to the side of the crankcase surface 5.

Figure 5B:
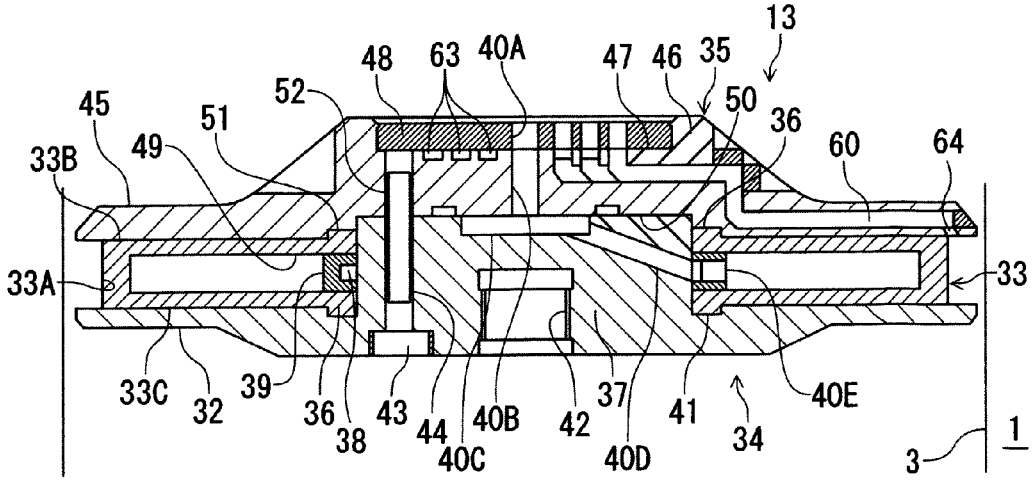

When the supply of the air from the main air joint member 22 into the sealing member 33 is cut off, as shown in FIG. 5B, the sealing member 33 is contracted in the radius direction, and the outer peripheral portion 33A is separated from the cylinder inner peripheral surface 3. Then, by the retracting operation of the air joint cylinder 29, the air joint 15 is separated from the sealing sheet 48 of the sealing jig 13, and returned to the standby position (FIG. 3).

A device for checking expansion and contraction of the sealing member 33 is provided in the sealing jig 13 and the air joint 15 as shown in FIG. 2. This checking device includes the sub air joint 58 and the sub air supply channel 59 in the air joint 15, and a sub air channel 60, an air pressure sensor 61, and a control circuit 62 in the sealing jig 13.

A plurality of, for example, three, sub air joints 58 are placed in the air joint 15. A plurality of, for example, three sub air supply channels 59 are formed in the air joint 15 correspondingly to the sub air joints 58 so as to communicate with the sub air joints 58, respectively.

As shown in FIG. 5, the sub air channel 60 is formed in the sealing base 35 of the sealing jig 13. In the sealing base 35, a plurality of (for example, three) concentric circular ring grooves 63 corresponding to the number of the sub air supply channels 59 are formed in a top surface of the expanded portion 46, and can communicate with sub air supply channels 59, respectively (FIG. 2). In the sealing base 35, a plurality of (for example, three) sub air channels 60 corresponding to the number of the ring grooves 63 are radially formed at an equal interval from each other. Each sub air channel 60 communicates with each ring groove 63. Each sub air channel 60 has an outlet 64 at an outer peripheral end of the sealing base 35. As shown in FIG. 5A, the outlet 64 is provided in a position where the outlet 64 is closed by the sealing member 33 at a time of expanding the sealing member 33 and is opened at a time of contracting the sealing member 33 (FIG. 5B).

The air as a fluid introduced from the sub air joint 58 provided in the air joint 15 shown in FIG. 2 passes through the sub air supply channel 59 and through the ring groove 63 and the sub air channel 60 in the sealing jig 13 (FIG. 5) and is then blown out from the outlet 64. The air is blown out from the outlet 64 when the outlet 64 is not closed by the sealing member 33 but opened in the contraction of the sealing member 33 as shown in FIG. 5B. At this time, the air pressure in the sub air channel 60, the sub air supply channel 59, and the sub air joint 58 is reduced. On the contrary, in the expansion of the sealing member 33, as shown in FIG. 5A, the outlet 64 is closed by the sealing member 33 and air is not blown out from the outlet 64, and the air pressure in the sub air channel 60, the sub air supply channel 59, and the sub air joint 58 is increased.

Air pressure sensors 61 shown in FIG. 2 are mounted to a plurality of, for example, three sub air supply pipes 65 so as to guide the air to the plurality of sub air joints 58 and detect the air pressure in the sub air channel 60. According to the detected value of the air pressure, the expansion or the contraction of the sealing member 33 of the sealing jig 13 can be checked. Specifically, it can be checked whether the sealing member 33 is expanded and brought into contact with the cylinder inner peripheral surface 3 of the cylinder block 1 to fluid-tightly seal the cylinder inner peripheral surface 3, or the sealing member 33 is contracted and not brought into contact with the cylinder inner peripheral surface 3 of the cylinder block 1, and the cylinder inner peripheral surface 3 is not sealed.

The seal of the cylinder inner peripheral surface 3 of the cylinder block 1 by the expansion and contraction of the sealing member 33 is checked over the entire circumference of the sealing member 33 because the plurality of sub air channels 60 are formed at an equal interval from each other in the circumferential direction of the sealing base 35 (that is, the sealing member 33). For example, three sub air channels 60 are formed at 120° interval in the circumferential direction of the sealing member 33. Thus, even if deterioration, crack or breakage occurs partly in the circumferential direction of the sealing member 33, and the sealing member 33 is insufficiently expanded in a position with the crack or the like and not brought into contact with the cylinder inner peripheral surface 3 of the cylinder block 1 although the sealing member 33 is normally expanded in other positions, the state of the expansion and contraction in the circumferential direction of the sealing member 33 can be checked to check the seal of the cylinder inner peripheral surface 3.

The detected value is inputted into the control circuit 62 shown in FIG. 2 from the air pressure sensor 61 so as to control the driving of the liquid feed pumps 24A and 24B and the power supply device 30. Specifically, in a case when the detected value from the air pressure sensor 61 is higher than a predetermined value, the control circuit 62 determines that the sealing member 33 of the sealing jig 13 is expanded and brought into contact with the cylinder inner peripheral surface 3 of the cylinder block 1, and the cylinder inner peripheral surface 3 on the side of the crankcase surface 5 is satisfactorily sealed. At this time, the control circuit 62 activates the liquid feed pump 24A or 24B to supply the process liquid to the space 27 defined by the cylinder inner peripheral surface 3 and the outer peripheral surface of the electrode 12, then drives the power supply device 30 to supply power to the electrode 12, and performs pre-plating processing (electrolytic etching treatment, anode oxidation treatment) or plating processing of the cylinder inner peripheral surface 3.

On the contrary, in a case when the detected value from the air pressure sensor 61 is the predetermined value or less, the control circuit 62 determines that the sealing member 33 of the sealing jig 13 is not properly expanded or is contracted, and not brought into contact with the cylinder inner peripheral surface 3, and the cylinder inner peripheral surface 3 is incompletely sealed. Then, the control circuit 62 does not drive the liquid feed pumps 24A and 24B and the power supply device 30, or stops the driving of the liquid feed pumps 24A and 24B and the power supply device 30 now being driven.

According to the structure mentioned above, the present embodiment provides the following functions and advantageous effects (1) to (3).

(1) The sealing jig 13 that seals the end of the cylinder inner peripheral surface 3 on the side of the crankcase surface 5 of the cylinder block 1 is provided at the upper end of the electrode 12. The air joint 15 that operates the sealing member 33 of the sealing jig 13 with air is separated from the sealing jig 13 and placed in the workpiece holding jig 14. The sealing jig 13 is inserted together with the electrode 12 from the end of the cylinder inner peripheral surface 3 on the side of the head surface 4 into the cylinder 2. The air joint 15 is inserted from the side of the crankcase surface 5 of the cylinder block 1 toward the cylinder 2 and connected to the sealing jig 13.

According to the above arrangement, even if there is provided the cylinder block 1 having a complex shape with the crank journal 6 as an obstacle around the end of the cylinder inner peripheral surface 3 on the side of the crankcase surface 5, the sealing jig 13 is inserted from the end of the cylinder inner peripheral surface 3 on the side of the head surface 4 into the cylinder 2, and hence, the sealing member 33 of the sealing jig 13 does not need to avoid the crank journal 6. Thus, the size of the sealing member 33 can be set close to the size of the cylinder inner peripheral surface 3, resulting in the reduction of the amount of expansion and contraction of the sealing member 33 of the sealing jig 13, thereby ensuring sealing accuracy by the sealing jig 13 and reliably sealing the cylinder inner peripheral surface 3 using the sealing jig 13.

Furthermore, since the amount of the expansion and the contraction of the sealing member 33 can be reduced, little burden is placed on the sealing member 33, thereby increasing the life of the sealing member 33.

(2) The inter-electrode channel 12A through which the process liquid passes is formed in the electrode 12, and the channel 67 through which the process liquid passes is also formed between the electrode support portion 20 that supports the electrode 12 and the channel constituting block 66.

Further, the electrode support portion 20, and the channel constituting block 66, the air joint 15 and the air joint cylinder 29 that supply working air to the sealing member 33 of the sealing jig 13 are placed above the electrode 12.

Thus, the air joint 15 and the air joint cylinder 29 are not brought into contact with the process liquid, thus being prevented from being secured or the like. Furthermore, the air joint 15 and the air joint cylinder 29 do not interfere with the inter-electrode channel 12A and the channel 67 in the channel constituting block 66, and thus, the flow of the process liquid is not disturbed in the channels 12A and 67, thereby increasing plating quality of the cylinder inner peripheral surface 3 of the cylinder block 1.

(3) The air joint 15 supplies the air for operating the sealing member 33 of the sealing jig 13, thereby reliably preventing defects such as a short circuit by the process liquid caused when the sealing member 33 is operated using an electric system.

The present invention is not limited to the above-described embodiment, and many other changes and modifications may be included without departing from the technical scope defined in the appended claims.

The invention claimed is:

1. A sealing mechanism of a cylinder block plate processing apparatus which includes the sealing mechanism that seals one end side of a cylinder inner peripheral surface of a cylinder of a cylinder block and in which a process liquid is guided to the cylinder inner peripheral surface to perform pre-plating processing or plating processing of the cylinder inner peripheral surface, the sealing mechanism comprising:

a sealing jig including a sealing member; and a driving mechanism that drives the sealing member, wherein the sealing jig is placed separately from the driving mechanism and at a front end portion of an electrode provided in the plate processing apparatus, the electrode and the sealing jig are inserted from an end side of the cylinder inner peripheral surface into the cylinder, and the driving mechanism is inserted from another end side so as to be connectable to the sealing jig, wherein the sealing jig includes the sealing member, a sealing plate that engages the sealing member, and a sealing base that engages the sealing member and the sealing plate, wherein the sealing member, the sealing plate, and the sealing base are integrally engaged so as to form a main air channel inside, and wherein the sealing member is further provided with a sub-air channel and a corresponding outlet to be closed by the sealing member.

2. The sealing mechanism of a cylinder block plate processing apparatus according to claim 1, wherein the sealing member of the sealing jig has an outer diameter close to an inner diameter of the cylinder inner peripheral surface.

3. The sealing mechanism of a cylinder block plate processing apparatus according to claim 1, wherein an elastic member for absorbing shock and ensuring air-tightness is provided to at least one of connecting portions of the sealing jig and the driving mechanism.

4. A cylinder block plate processing apparatus in which one end side of a cylinder inner peripheral surface of a cylinder of a cylinder block is sealed to thereby circulate a process liquid to perform pre-plating processing or plating processing of the cylinder inner peripheral surface, the apparatus comprising:

an apparatus body having a workpiece mount table on which the cylinder block is placed;

a workpiece holding tool that is provided on the workpiece mount table so as to be vertically movable;

an electrode support member including an electrode cylinder mounted to the apparatus body;

a processing solution supply member that supplies a processing solution to the electrode support member;

an electrode operated by the electrode cylinder;

a sealing jig provided at one end of the electrode;

a driving mechanism that drives the sealing jig; and a control circuit that controls operations of the processing solution supply member and the driving mechanism, wherein the sealing jig includes a sealing member, the driving mechanism that drives the sealing member includes an air cylinder placed separately from the sealing jig, wherein the sealing jig further includes a sealing plate that engages the sealing member, and a sealing base that engages the sealing member and the sealing plate, wherein the sealing member, the sealing plate, and the sealing base are integrally engaged to form an air channel inside, wherein the electrode and the sealing jig are inserted from an end side of the cylinder inner peripheral surface into the cylinder, and the driving mechanism is inserted from another end side of the inner peripheral surface so as to be connectable to the sealing jig the electrode being formed with a channel for the process liquid supplied to the cylinder inner peripheral surface, wherein the driving mechanism is placed to an upper portion of the electrode and the sealing jig, and wherein the sealing plate includes a sealing lower plate having a disk portion having a central portion in which an expanded portion is formed.

* * * * *